US012589272B1

(12) United States Patent
Yin

(10) Patent No.: US 12,589,272 B1
(45) Date of Patent: Mar. 31, 2026

(54) LEG TRAINING DEVICE FOR SEATED BIDIRECTIONAL TRAINING

(71) Applicant: Zhong Yin, Zhejiang (CN)

(72) Inventor: Zhong Yin, Zhejiang (CN)

( * ) Notice: Subject to any disclaimer, the term of this patent is extended or adjusted under 35 U.S.C. 154(b) by 0 days.

(21) Appl. No.: 19/346,507

(22) Filed: Sep. 30, 2025

(51) Int. Cl.
*A63B 21/06* (2006.01)
*A63B 21/00* (2006.01)
*A63B 23/04* (2006.01)

(52) U.S. Cl.
CPC ..... *A63B 21/0615* (2013.01); *A63B 21/154* (2013.01); *A63B 21/4031* (2015.10); *A63B 23/04* (2013.01); *A63B 2208/0233* (2013.01); *A63B 2225/09* (2013.01)

(58) Field of Classification Search
CPC ..... A63B 21/0615; A63B 21/154; A63B 21/4031; A63B 23/04; A63B 2208/0233; A63B 2225/09
See application file for complete search history.

(56) References Cited

U.S. PATENT DOCUMENTS 4,749,190 A * 6/1988 Jennings ..... A63B 21/4031 482/104
4,765,613 A * 8/1988 Voris ..... A63B 21/4047 482/901
5,042,801 A * 8/1991 Sterba ..... A63B 21/4031 482/142
5,211,614 A * 5/1993 Henes ..... A63B 21/0628 482/133
5,242,351 A * 9/1993 Berg ..... A63B 21/153 482/110
5,267,930 A * 12/1993 Henes ..... A63B 21/154 482/133
5,716,308 A * 2/1998 Lee ..... A63B 23/00 482/130
6,319,178 B1 * 11/2001 Webber ..... A63B 21/4043 482/137
8,388,499 B1 * 3/2013 Rindfleisch ..... A63B 23/1209 482/8
10,086,229 B2 * 10/2018 Meredith ..... A63B 23/03566
2007/0254787 A1 * 11/2007 Matsubara ..... A63B 21/0058 482/92
2008/0051684 A1 * 2/2008 Gamada ..... A63B 23/0494 602/26
2008/0090710 A1 * 4/2008 Chung ..... A63B 21/08 482/142
2011/0009249 A1 * 1/2011 Campanaro ..... A63B 23/12 482/131

(Continued)

*Primary Examiner* — Garrett K Atkinson
(74) *Attorney, Agent, or Firm* — Hawaii Patent Services; Nathaniel K. Fedde; Kenton N. Fedde

(57) ABSTRACT

The present disclosure relates to a leg training device for seated bidirectional training, comprising a base, a seat and a main upright. Through the synergistic action of multi-angle positioning by the adjustment disk and the drive arm assembly, users can quickly switch between kick training and leg curl training modes without changing their sitting posture. The device is equipped with an adjustable leg press roller, a backrest and a dual resistance adjustment system, effectively addressing the issues of single functionality and cumbersome mode switching in traditional equipment, thereby achieving efficient and convenient comprehensive leg training.

20 Claims, 9 Drawing Sheets

(56) References Cited

U.S. PATENT DOCUMENTS

| | | | | |
|---|---|---|---|---|
| 2011/0263389 | A1* | 10/2011 | Burgassi | A63B 21/4047 482/79 |
| 2014/0066276 | A1* | 3/2014 | Hornback | A63B 21/00069 482/145 |
| 2021/0197054 | A1* | 7/2021 | Gainford | A63B 69/002 |
| 2025/0325868 | A1* | 10/2025 | Kim | A63B 21/4045 |
| 2025/0332476 | A1* | 10/2025 | Marín Alcalá | A63B 23/0417 |

* cited by examiner

LEG TRAINING DEVICE FOR SEATED BIDIRECTIONAL TRAINING

TECHNICAL FIELD

The present disclosure relates to the technical field of fitness equipment, particularly to a leg training device for seated bidirectional training.

BACKGROUND

Current mainstream leg training devices have significant functional design shortcomings, particularly exhibiting strong functional limitations in seated training mode. These devices typically only support users performing leg extension training in a sitting posture: requiring the upper body to remain upright and pressed against the backrest, with feet fixed on front pedals, stimulating muscle groups through forward leg extension. However, this structure cannot accommodate leg curl training mode.

If users wish to perform leg curl training to target hamstrings, calf posterior muscles, etc., cumbersome adjustments are required. First, manual adjustment of the seat height or tilt angle is needed, and some equipment even requires disassembly, relocation, or reinstallation of accessories. Subsequently, users must completely change their body posture, switching from a sitting position to a prone position and refastening their legs to components on the other side of the equipment.

This conversion process is not only time-consuming but also disrupts training rhythm, affecting workout continuity. For individuals with weaker strength or middle-aged and elderly users, frequent posture changes and equipment operations are not only inconvenient but also pose certain safety risks. Existing designs severely limit training efficiency and diversity, making it difficult to meet users' functional needs for comprehensive leg training.

SUMMARY

The present disclosure provides a leg training device for seated bidirectional training to solve the problems mentioned in the background art.

To achieve the above-mentioned object, the present disclosure adopts the following technical solutions:

A leg training device for seated bidirectional training comprises a base; a seat arranged on the base; a resistance system for providing a training resistance; a main upright fixedly mounted on the base; an adjustment disk rotatably mounted on the main upright, the adjustment disk comprising a plurality of adjustment holes for angle positioning; a telescopic sleeve, comprising an outer tube and an inner tube slidably nested within the outer tube, the outer tube rotatably mounted on the main upright and adjacent to the adjustment disk; an angle locking mechanism for locking the adjustment disk and the telescopic sleeve at a selected angle; a drive roller mounted at a distal end of the inner tube of the telescopic sleeve; and a transmission mechanism connected between the adjustment disk and the resistance system for transmitting rotation of the drive roller to the resistance system.

By selectively locking an angle of the adjustment disk and the telescopic sleeve through the angle locking mechanism, the drive roller is switchable between different angular positions from a front upper position to a rear lower position of a leg, enabling a user to perform both kick training and leg curl training in a same sitting posture.

A leg training device for seated bidirectional training comprises a base; a seat arranged on the base; a resistance system for providing a training resistance; a main upright fixedly mounted on the base; an adjustment disk rotatably mounted on the main upright, the adjustment disk comprising a plurality of adjustment holes for angle positioning; a drive arm assembly, with a proximal end thereof rotatably mounted on the main upright and arranged adjacent to the adjustment disk, a length of the drive arm assembly being adjustable; an angle locking mechanism for locking the adjustment disk and the drive arm assembly at a selected angle; a drive roller mounted at a distal end of the drive arm assembly; and a transmission mechanism connected between the adjustment disk and the resistance system for transmitting rotation of the drive roller to the resistance system. By selectively locking an angle between the adjustment disk and the drive arm assembly through the angle locking mechanism, the drive roller is switchable between different angular positions from a front upper position to a rear lower position of a leg, enabling a user to perform both kick training and leg curl training in a same sitting posture.

The beneficial effects of the present disclosure compared to the prior art are as follows:

The present disclosure, through the collaborative operation of a multi-angle adjustable adjustment disk and the drive arm assembly, enables users to swiftly and safely switch between kicking and leg-bending training modes without altering their sitting posture. It effectively addresses the shortcomings of traditional leg training devices, such as limited functionality, cumbersome and time-consuming mode switching, and easily disrupted training rhythm. Additionally, by incorporating independently adjustable drive arm length and resistance system, it significantly enhances the device's adaptability to users of different body types and training comfort. While greatly improving training efficiency and safety, it delivers an efficient, convenient, and comprehensive leg training experience.

BRIEF DESCRIPTION OF DRAWINGS

The drawings, which form part of this application, are provided to further illustrate the present disclosure. The illustrative embodiments and the descriptions thereof serve to explain the present disclosure and do not constitute an undue limitation thereof. In the drawings.

Figure 1:
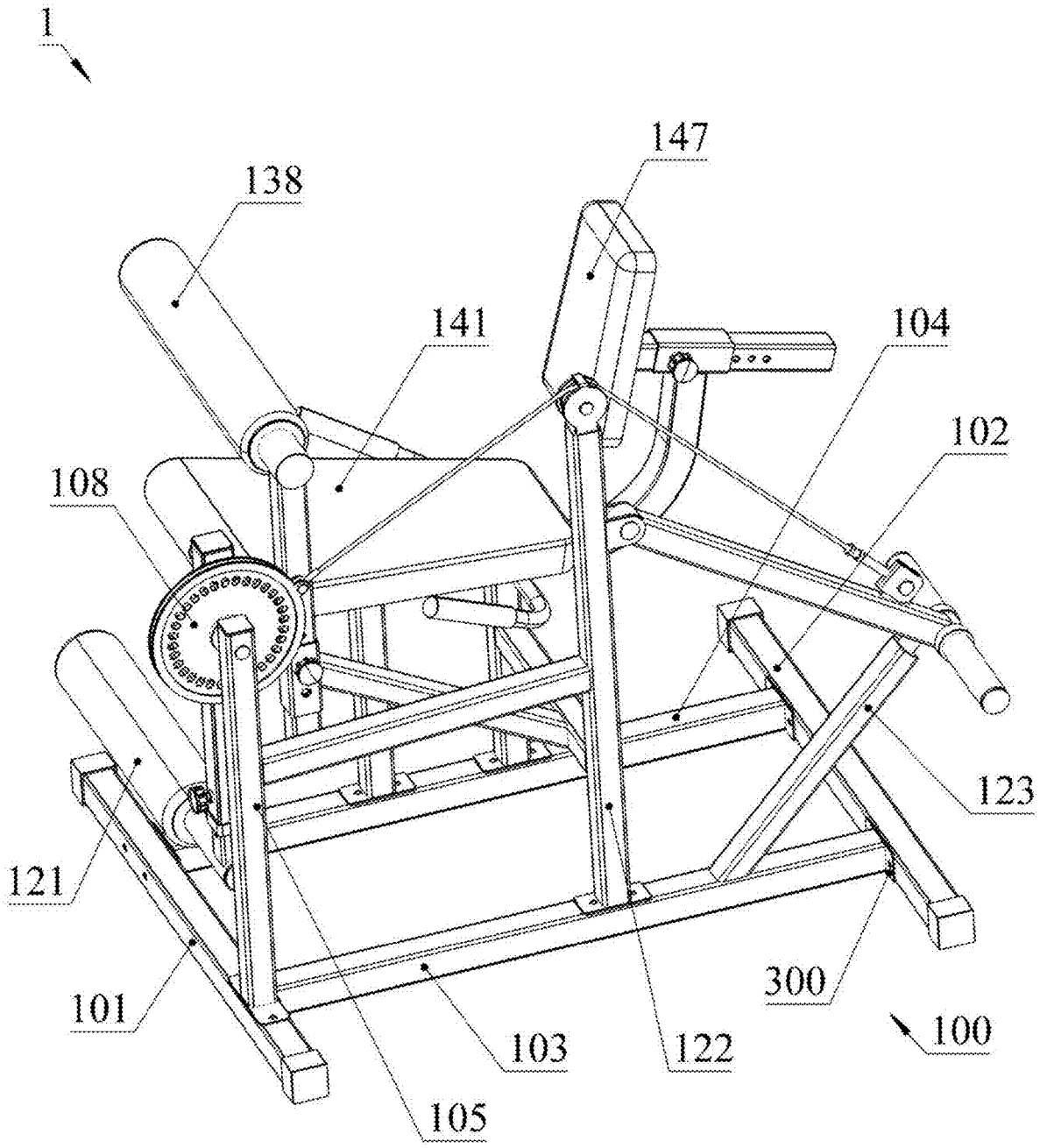
FIG. 1 is a perspective view of an embodiment provided by the present disclosure.

Reference signs: Leg Training Device for Seated Bidirectional Training (1); Base (100); First Crossbar (101); Second Crossbar (102); First Vertical Bar (103); Second Vertical Bar (104); Main Upright (105); Rotating Shaft (106); Extension Part (107); Adjustment Disk (108); Protrusion (109); Telescopic Sleeve (110); Outer Tube (111); Inner Tube (112); Adjustment Pin (114); Head Part (115); Limiting Plate (116); Spring (117); First Threaded Pin (118); First Threaded Hole (119); First Through Hole (120); Drive Roller (121); Transition Bar (122); Inclined Bar (123); Pulley Assembly (124); Buffer Pad (125); First Reinforcing Bar (126); Swinging Arm (127); Weight Arm (128); Rope (129); Support Bar (130); Second Reinforcing Bar (131); Connecting Bar (132); First Bushing (133); Second Threaded Hole (134); Second Threaded Pin (135); Leg Press Bar (136); Second Through Hole (137); Leg Press Roller (138); Seat Mounting Bar (139); Handle (140); Seat (141); Curved Bar (142); Second Bushing (143); Third Threaded Hole (144); Third Threaded Pin (145); Backrest Mounting Bar (146); Backrest (147); Third Through Hole (148); Mounting Flange (300); Adjustment Hole (301).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

In the present disclosure, addressing issues such as the single functionality of existing leg training devices, cumbersome switching between training modes, easily interrupted training rhythm, and poor adaptability, a leg training device for seated bidirectional training is provided. Through the coordinated adjustment of a multi-angle positioning adjustment disk and a telescopic sleeve, this device enables users to quickly and safely switch between kicking and leg curl training modes without changing their sitting posture. With independently adjustable leg press rollers, a backrest, and a dual resistance adjustment system, it significantly enhances the device's adaptability to users of different body types and improves training comfort. This effectively resolves the pain points of traditional devices, such as low training efficiency, complex operation, and insufficient safety, achieving efficient, convenient, and comprehensive leg training. Below, the specific embodiments of the leg training device for seated bidirectional training according to the present disclosure will be described in detail with reference to the accompanying drawings.

As shown in FIG. 1, the present disclosure provides a leg training device for seated bidirectional training 1, including a base 100. The base 100 includes a first crossbar 101 and a second crossbar 102 arranged parallel to each other. Between the first crossbar 101 and the second crossbar 102, a first vertical bar 103 and a second vertical bar 104 are provided, and the first crossbar 101 and the second crossbar 102 are connected to form a stable rectangular frame. The first vertical bar 103 and the second vertical bar 104 are arranged parallel to each other, effectively enhancing the symmetry and force balance of the structure, which helps improve the overall stability of the fitness equipment. Both ends of the first vertical bar 103 and the second vertical bar 104 are equipped with mounting flanges 300, through which they are securely fixed to the first crossbar 101 and the second crossbar 102, ensuring a more robust and reliable connection. This framed base 100 not only offers excellent support strength and resistance to deformation but also provides a stable installation foundation for various moving components of the leg training device, ensuring user safety and the device's service life during operation. In other embodiments (not shown), to accommodate different application scenarios, the first crossbar 101 can also be fixed using connection methods such as magnetic attachment, mortise-and-tenon joints, or snap-fit connections. These diverse connection structures offer versatile design choices and implementation flexibility, better adapting to differentiated application scenarios, production processes, and user needs-such as meeting design goals like rapid assembly, portable disassembly, or specific structural strength-thereby enhancing the product's market adaptability and implementation feasibility.

Figure 2:
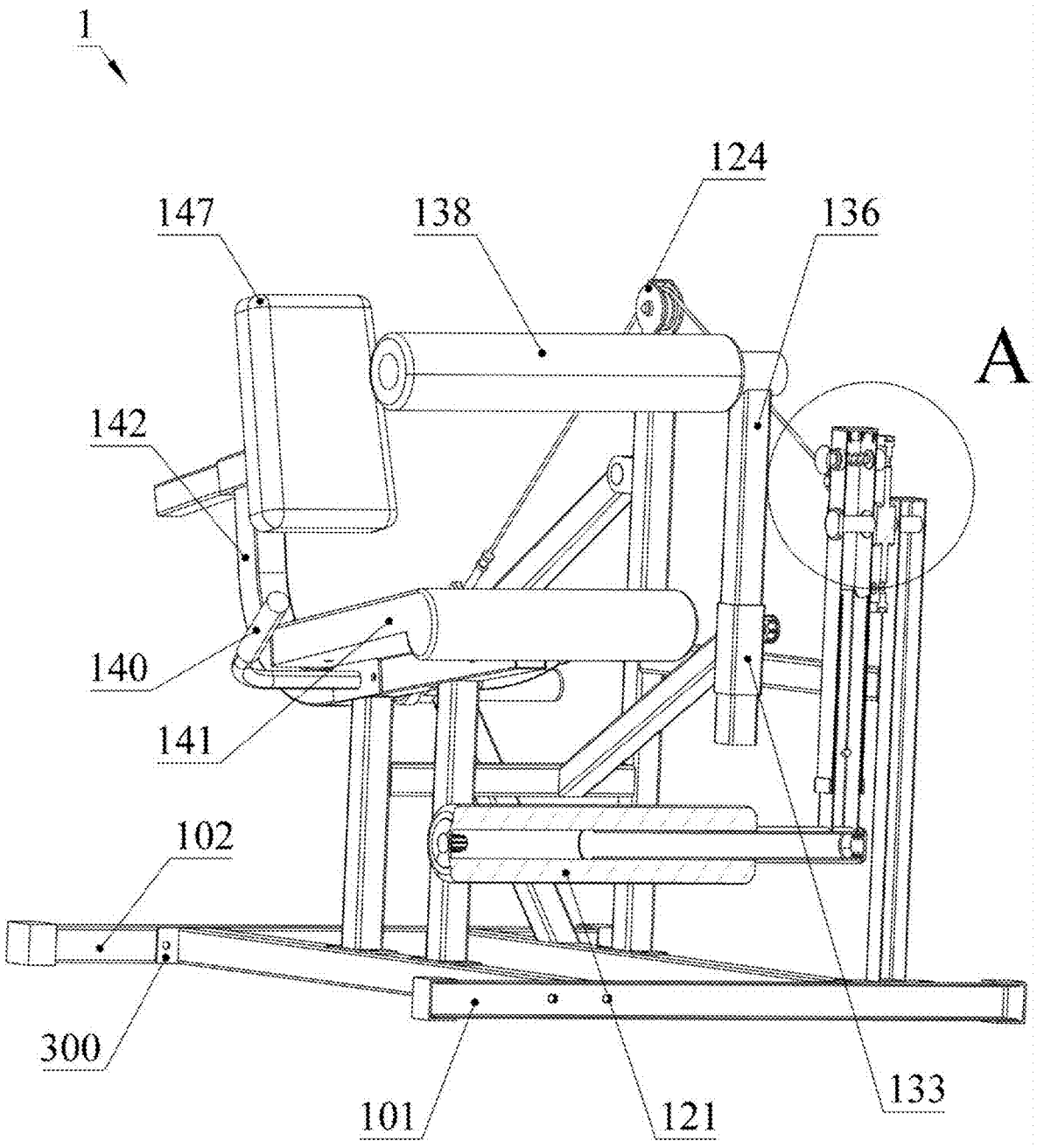
FIG. 2 is a cross-sectional view of the drive arm assembly in the embodiment of FIG. 1.
Figure 3:
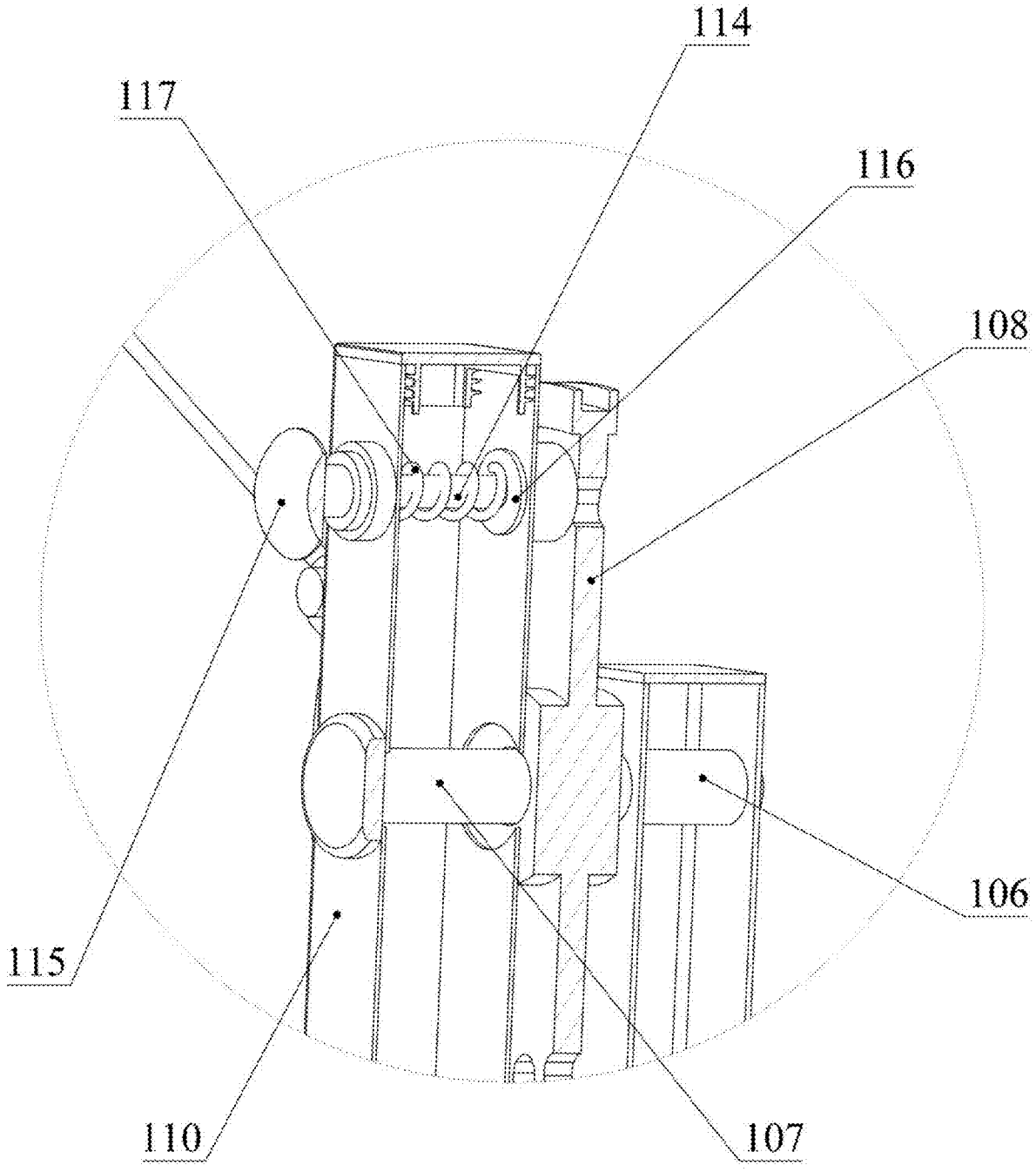
FIG. 3 is a partial enlarged view of section A in the embodiment shown in FIG. 2.
Figure 4:
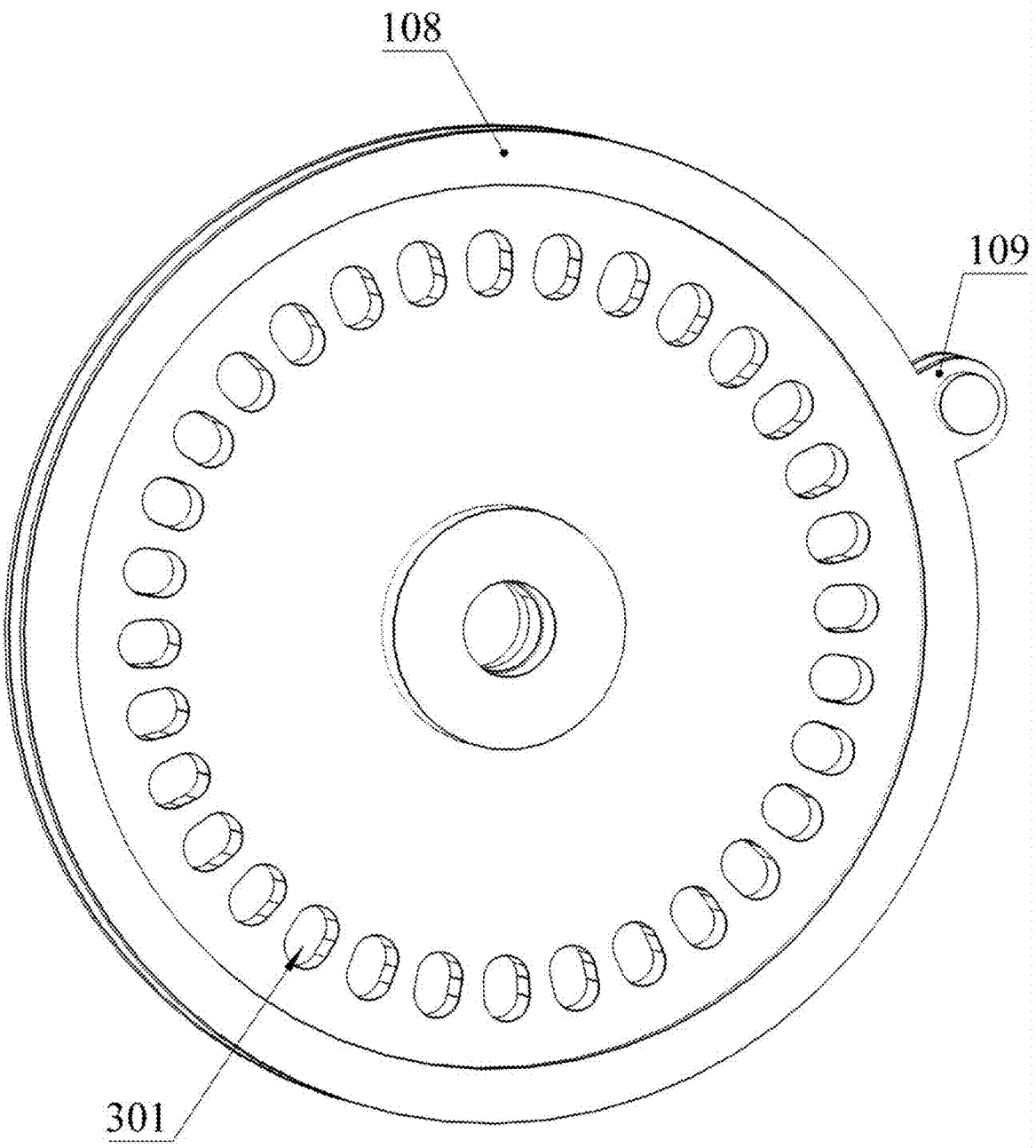
FIG. 4 is a perspective view of the adjustment disk in the embodiment shown in FIG. 1.

As shown in FIGS. 2, 3, and 4, the main upright 105 is fixedly mounted on the first crossbar 101 through a mounting flange 300. The distal end of the main upright 105 is equipped with a rotating shaft 106, which extends toward the second vertical bar 104 to form an extension part 107. The extension part 107 is rotatably fitted with an adjustment disk 108 for adjusting resistance and training modes and a drive arm assembly. The adjustment disk 108 is circular in shape, with adjustment holes 301 arranged in a circumferential array along its outer ring. The circular edge of the adjustment disk 108 features a protrusion 109, which is primarily used to transmit driving force during user training. In other embodiments (not shown), the structure of the adjustment disk 108 can also be designed in various geometric shapes such as rectangular or star-shaped. These morphological variations not only enhance the product's visual identity and aesthetic value but also cater to different functional requirements and user preferences. For example, a star-shaped structure may provide more angular adjustment points, increasing the precision of training angle fine-tuning, while a rectangular design may be more space-efficient or compatible with specialized mechanical structures. Diverse styling designs can meet the aesthetic inclinations and usage habits of different user groups, strengthening the product's market adaptability and personalized user experience.

Figure 5:
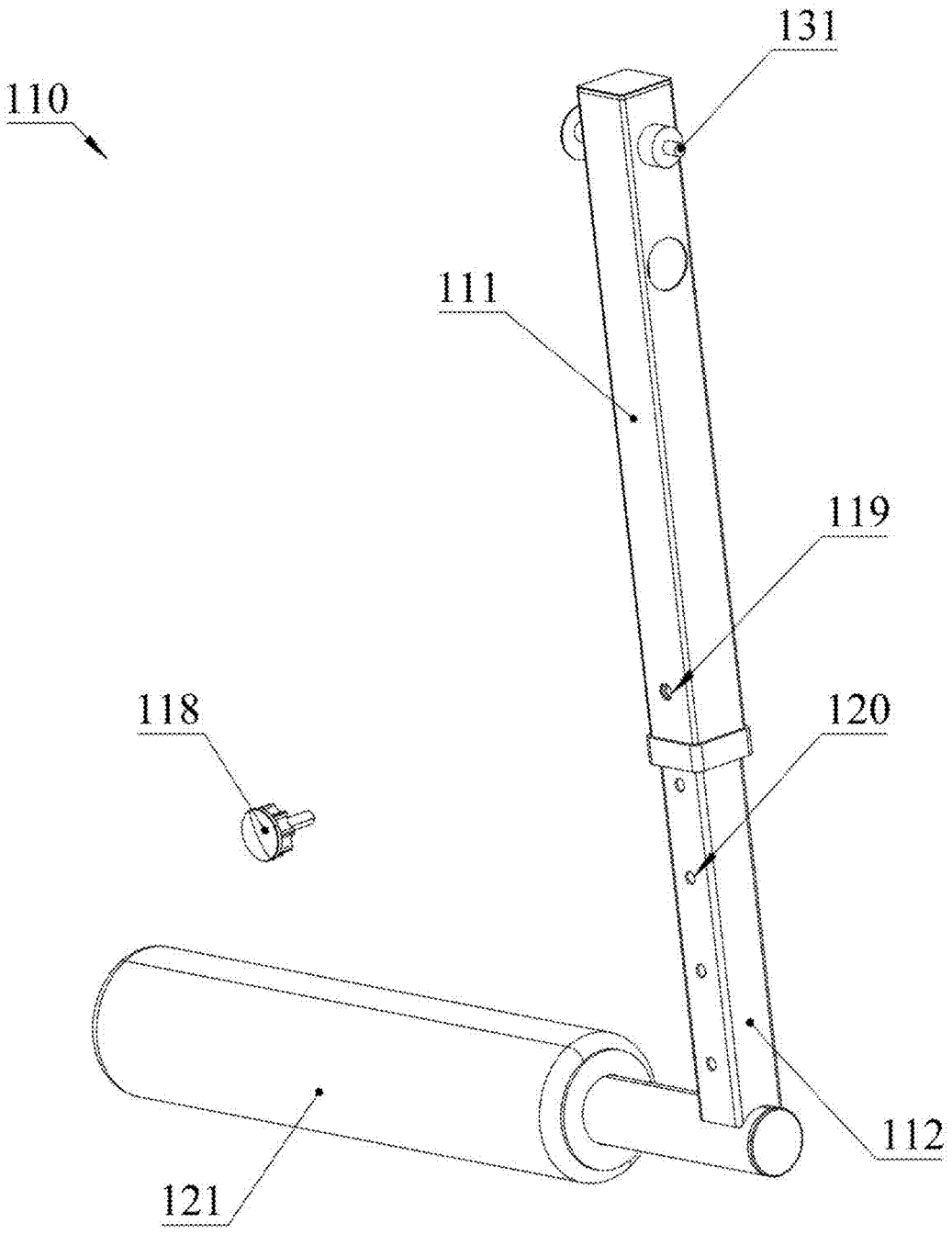
FIG. 5 is a connection diagram of the drive roller in the embodiment shown in FIG. 1.

Specifically, referring to FIG. 5, in the preferred embodiment of the present disclosure, the drive arm assembly is a telescopic sleeve 110, which consists of an outer tube 111 and an inner tube 112 slidably nested within it. The outer tube 111 is located on the side of the adjustment disk 108 away from the main upright 105 and is rotatably mounted through the extension part 107 of the rotating shaft 106. The sidewall of the outer tube 111 has a through-hole (not shown) corresponding to the adjustment hole 301 of the adjustment disk 108. The through-hole is equipped with an angle locking mechanism, including an adjustment pin 114 that can be inserted into the adjustment hole 301 and a return spring assembly to keep the adjustment pin 114 in the inserted state. The adjustment pin 114 is mounted in the through-hole and features a head part 115 with a diameter larger than the through-hole and a limiting plate 116. The return spring assembly is positioned between the head part 115 and the limiting plate 116 of the adjustment pin 114. The return spring assembly is preferably a spring 117, which is sleeved over the adjustment pin 114. When the adjustment pin 114 is mounted in place, the head part 115 remains outside the outer tube 111, while the limiting plate 116 is inside and abuts against the sidewall near the adjustment disk 108. The spring 117 abuts the sidewall of the outer tube 111 at one end and the limiting plate 116 at the other. This structure ensures that the adjustment pin 114 remains inserted into the adjustment hole 301 in its natural state, guaranteeing reliable angle locking. when adjustment is required, it simply needs to pull out the pin to release the lock, rotate to the desired position, and release—the pin automatically relocks under the force of the spring 117. Once locked, the telescopic sleeve 110 forms a rigid connection with the adjustment disk 108, enabling synchronized rotation. When the adjustment pin 114 is mounted in the telescopic sleeve 110, the limiting plate 116 effectively prevents the pin from dislodging from the through-hole. This design simplifies and speeds up the adjustment of training angles, allowing the entire process to be completed with one hand. It not only ensures efficiency when switching between different training modes but also guarantees stability and safety during training through mechanical self-locking, significantly improving the device's usability and user experience.

As shown in FIG. 5, the telescopic sleeve 110 is also equipped with a length adjustment mechanism. Specifically, the telescopic sleeve 110 includes a first threaded pin 118. The side wall of the outer tube 111 is provided with a first threaded hole 119, and the inner tube 112 has a plurality of first through holes 120 distributed axially. This length adjustment mechanism consists of the first threaded pin 118, the first threaded hole 119, and the first through holes 120. When adjusting the extended length of the telescopic sleeve 110, the user only needs to remove the first threaded pin 118, slide the inner tube 112 to the desired position, align the corresponding first through hole 120 with the first threaded hole 119, and then reinsert the first threaded pin 118 to complete the locking. This mechanical length adjustment method features a simple structure and reliable locking, accommodating limb length differences among users to ensure optimal training posture and force application for all body types. In other embodiments (not shown), to meet diverse user needs, the drive arm assembly may adopt non-telescopic arms or power telescopic components such as gas springs, hydraulic rods, or electric actuators. These powered telescopic methods offer smoother length adjustment and even dynamic resistance adjustment during training, delivering a more premium training experience and broader functional possibilities.

Referring to FIGS. 1 and 5, in this embodiment, the end of the inner tube 112 away from the outer tube 111 is equipped with a drive roller 121, which directly acts on the user's leg to provide training resistance. To accommodate body size variations among users, the device features a dual adjustment mechanism: the adjustment disk 108 alters the working angle of the drive roller 121, switching between kick or leg curl training modes, while the telescopic sleeve 110 adjusts the extended length of the drive roller 121 to precisely match users' limb dimensions. This dual-adjustment design enables the device to adapt to users of all sizes, from petite to tall, ensuring ergonomically correct training postures for everyone. Users can quickly personalize settings without changing seats or body positions, significantly improving device applicability and training safety while delivering consistent high-quality training experiences across body types.

Figure 6:
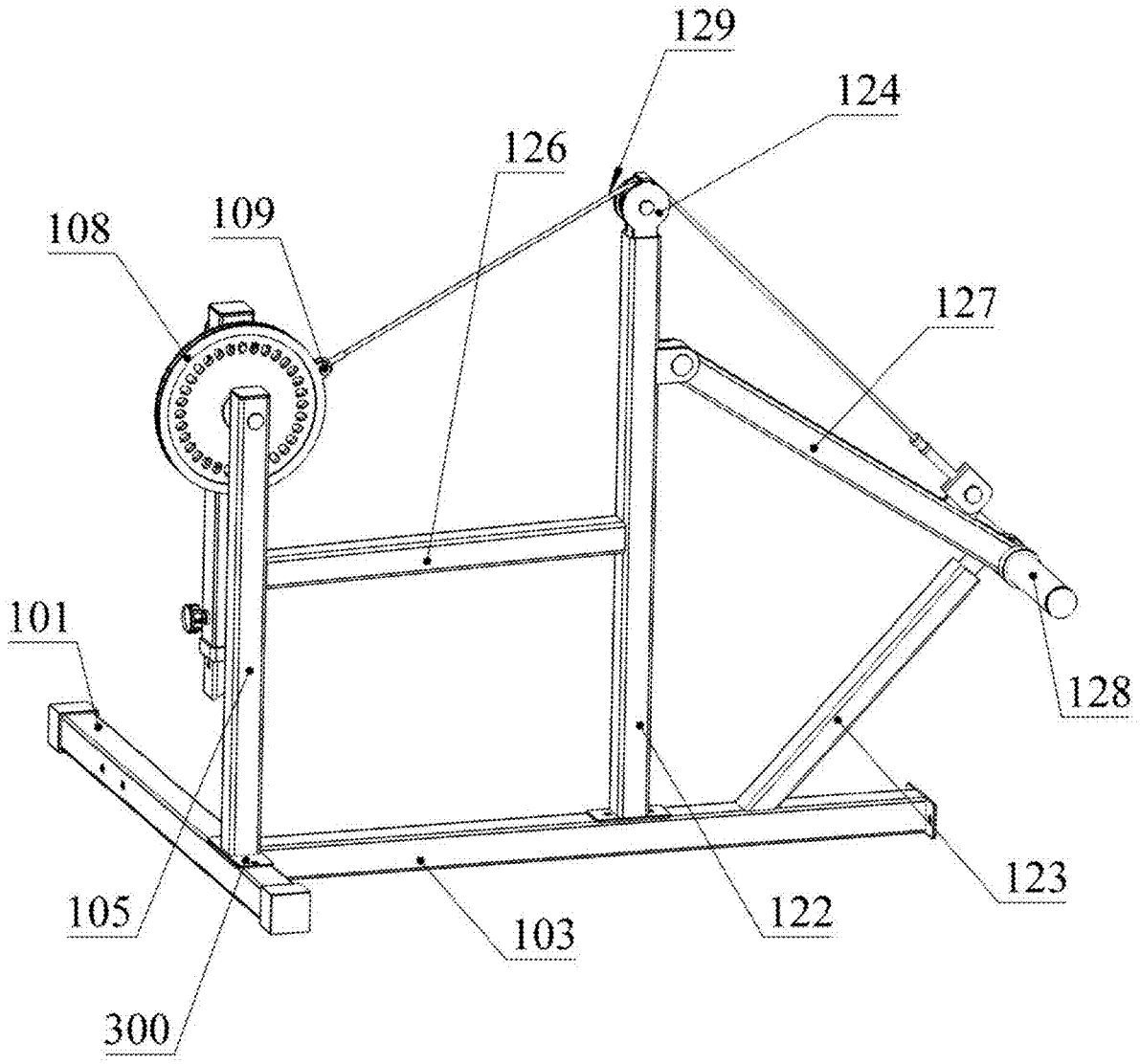
FIG. 6 is a connection diagram of the transmission mechanism in the embodiment shown in FIG. 1.

As shown in FIG. 6, the first vertical bar 103 is also fixedly equipped with a transition bar 122 and an inclined bar 123 through a mounting flange 300. The distal end of the transition bar 122 is fitted with a pulley assembly 124, while the distal end of the inclined bar 123 is provided with a buffer pad 125 to absorb impact forces during movement. To further enhance structural stability, a first reinforcing bar 126 is connected between the transition bar 122 and the main upright 105 through the mounting flange 300. Near the inclined bar 123 on the transition bar 122, a resistance system is mounted to provide training resistance. This system includes a swinging arm 127, whose end extends into a weight arm 128, allowing users to attach weight plates (not shown) for adjustable training resistance. Specifically, the swinging arm 127 is equipped with a transmission mechanism, which is connected between the adjustment disk 108 and the resistance system. The transmission mechanism consists of a rope 129, with one end pivotally mounted to the swinging arm 127 and the other end passing through the pulley assembly 124 before being fixed to the protrusion 109 of the adjustment disk 108. The pulley assembly 124 significantly optimizes the force transmission path, effectively reducing friction during the rope's movement and ensuring smoother, more stable training motions. This integrated design not only guarantees the effective operation of the resistance system but also enhances the overall rigidity of the equipment through reinforced structures, providing stable and reliable support for users during training under varying loads.

Figure 7:
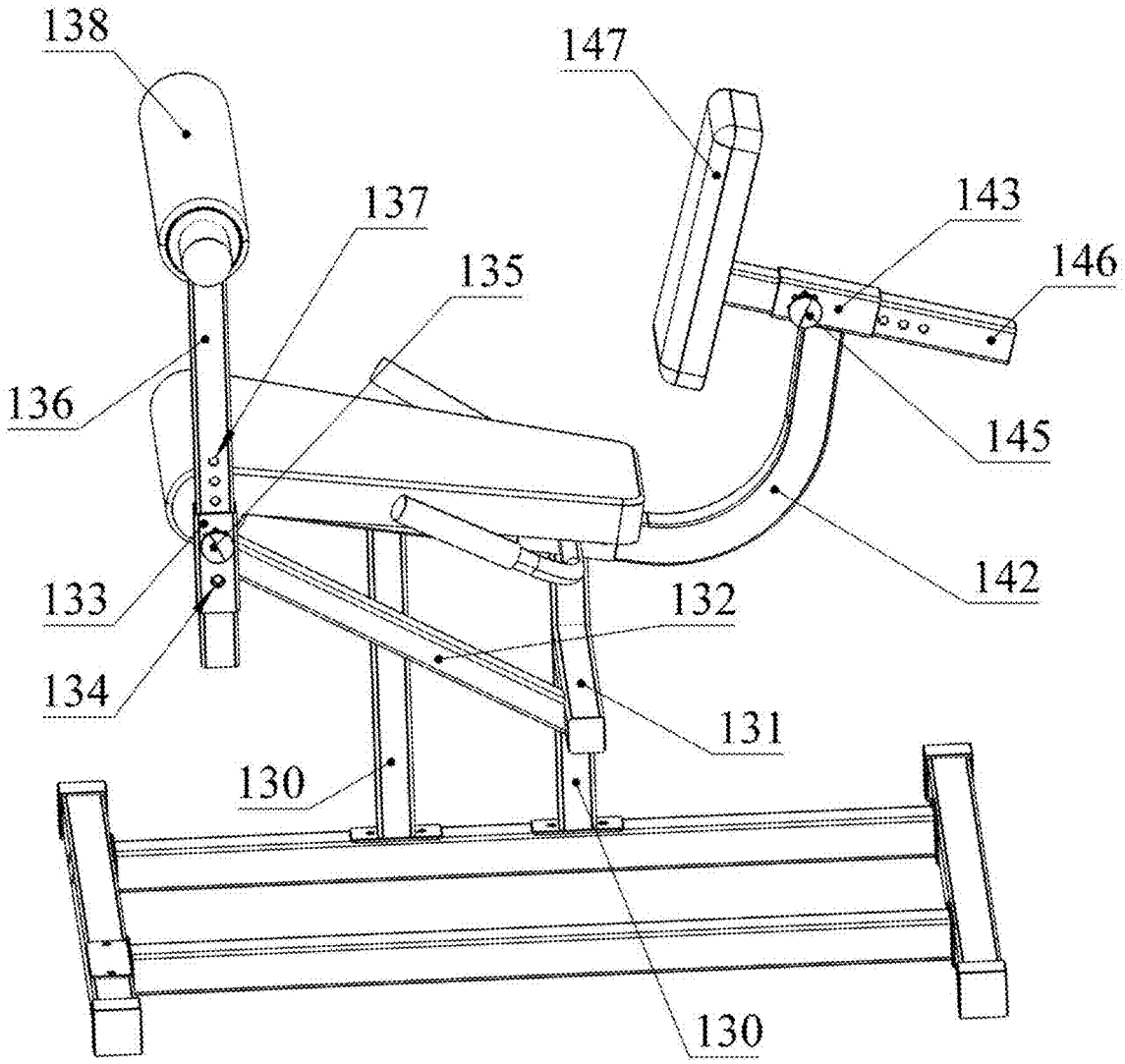
FIG. 7 is a connection diagram of the leg press roller in the embodiment shown in FIG. 1.

Specifically, referring to FIG. 7, in this embodiment, the second vertical bar 104 is fixedly equipped with a support bar 130 through a mounting flange 300. Between the mounting bar and the transition bar 122, a second reinforcing bar 131 is mounted using the mounting flange 300, and a stable connection between the two is achieved through the second reinforcing bar 131. The second reinforcing bar 131 is inclinedly fitted with a connecting bar 132, at the end of which a first bushing 133 is provided. The first bushing 133 is equipped with a second threaded hole 134 and a second threaded pin 135. A leg press bar 136 is slidably mounted inside the first bushing 133, with the leg press bar 136 featuring a plurality of second through holes 137 along its axis. At the end of the leg press bar 136, a leg press roller 138 is vertically mounted to stabilize the user's legs during training. To accommodate differences in leg length and body size among users, the position of the leg press roller 138 can be flexibly adjusted: the user only needs to remove the second threaded pin 135, slide the leg press bar 136 to the desired position, align the target second through hole 137 with the second threaded hole 134, and then reinsert the second threaded pin 135 to complete fixation. This adjustment mechanism is simple and reliable, enabling quick adaptation to different users' physiological characteristics, ensuring the accuracy and comfort of training postures, while also enhancing the flexibility and user-friendly experience of the equipment, effectively supporting personalized training needs.

Figure 8:
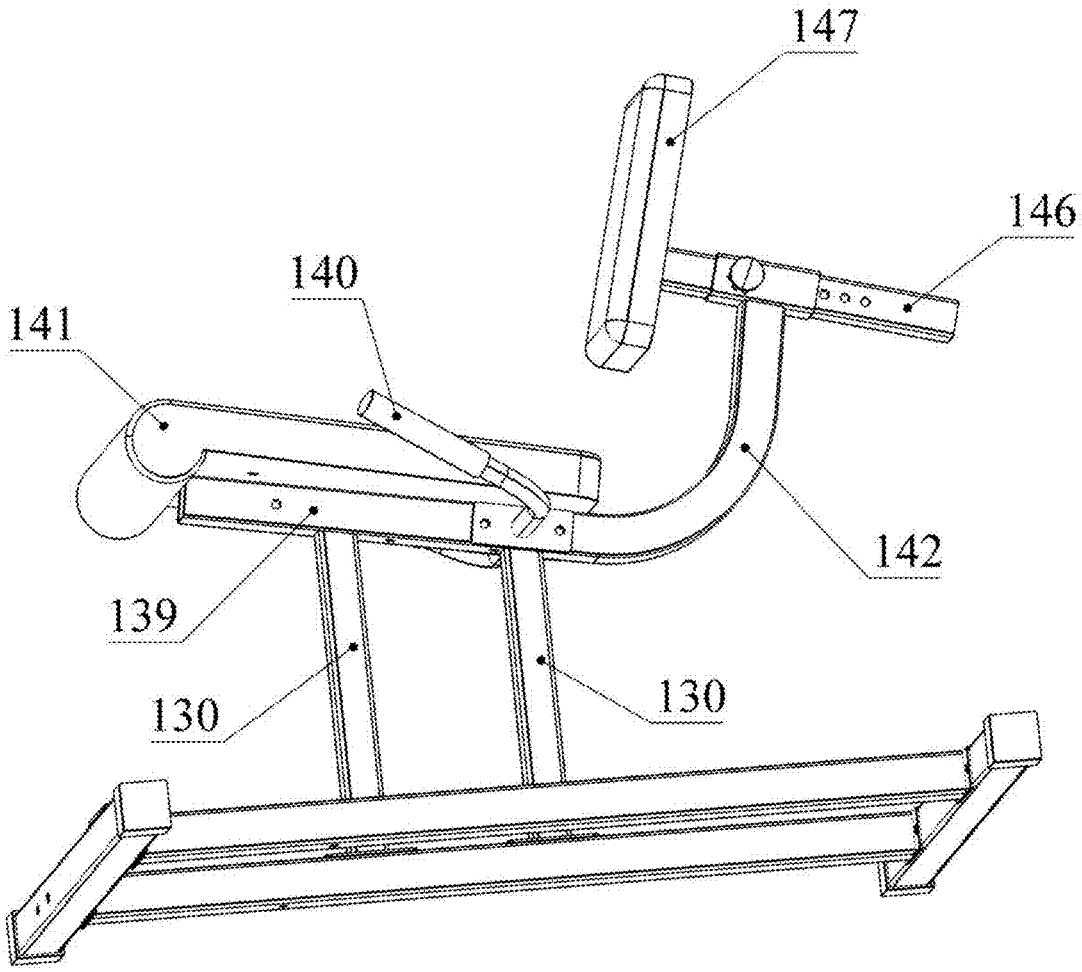
FIG. 8 is a connection diagram of the seat in the embodiment shown in FIG. 1.
Figure 9:
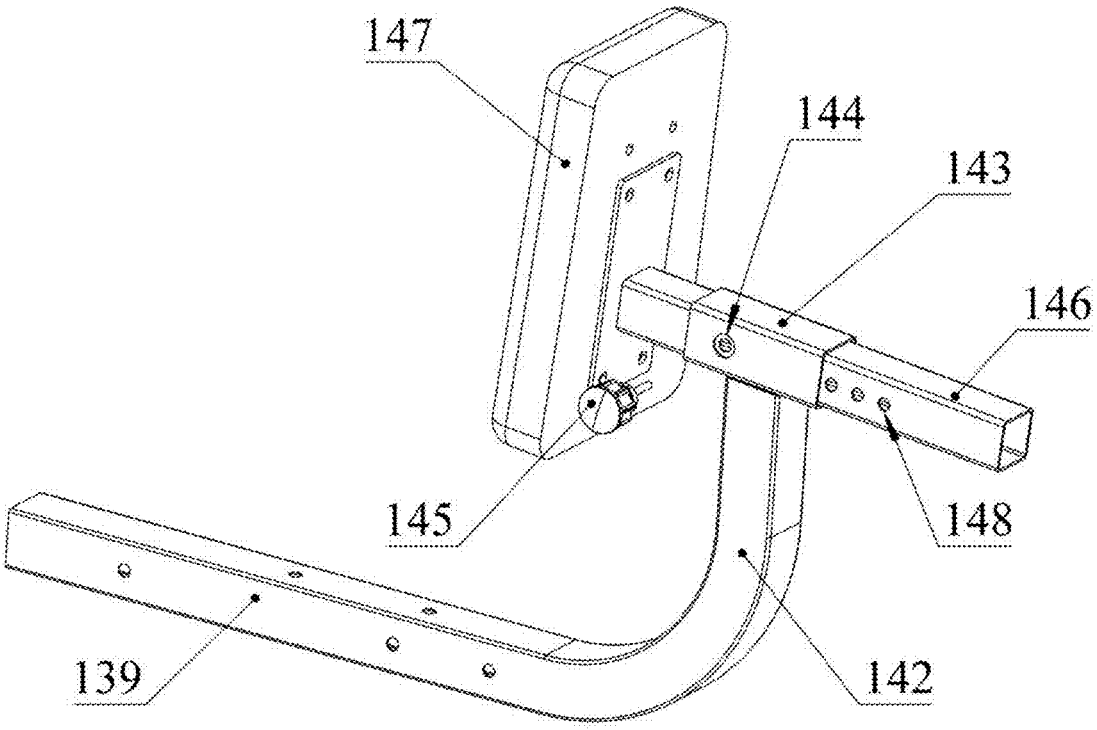
FIG. 9 is a connection diagram of the backrest in the embodiment shown in FIG. 8.

As shown in FIGS. 8 and 9, a seat mounting bar 139 is positioned above the support bar 130, with handles 140 mounted on both sides of the seat mounting bar 139. The arrangement of the handles 140 allows users to gain stable support by gripping them during leg exercises, effectively enhancing body balance and training safety. A seat 141 is mounted above the seat mounting bar 139. Extending from the seat mounting bar 139 away from the leg press roller 138 is a curved bar 142, at the end of which a second bushing 143 is located. This second bushing 143 is arranged roughly parallel to the seat 141. The second bushing 143 features a third threaded hole 144 and is fitted with a third threaded pin 145, while a backrest mounting bar 146 is slidably mounted inside the bushing. A backrest 147 is vertically fixed to the end of the backrest mounting bar 146 facing the seat 141, and the bar body of the backrest mounting bar 146 has a plurality of third through holes 148 along its axis. When users need to adjust the position of the backrest 147, they simply remove the third threaded pin 145, slide the backrest mounting bar 146 to the desired position, align the target third through hole 148 with the third threaded hole 144, and reinsert the threaded pin to complete the locking. This adjustable backrest 147 design enables users to flexibly adjust the angle and fore-aft position of the backrest 147 according to their body type and training habits, significantly improving seating comfort and training stability while ensuring optimal body support and posture for users of different sizes. The collaborative design of the handles 140 and the adjustable backrest 147 collectively enhances the ergonomic performance and overall user experience of the equipment.

Referring to FIG. 1, when using this leg training device, the leg press bar 136 is positioned laterally beside the seat 141, providing the user with an unobstructed front access channel, greatly enhancing the convenience of getting on and off the equipment. Users can first adjust the positions of the leg press roller 138 and the backrest 147 according to their body size to achieve a comfortable and stable training posture. Before starting the training, the resistance can be adjusted in two ways: one is by changing the starting angle of the drive roller 121 through the adjustment disk 108 to adjust the torque; the other is by directly altering the load intensity by adding or removing weight plates on the weight arm 128. After adjustments, the user drives the rotation of the drive roller 121 by exerting force with their legs, which in turn synchronously rotates the adjustment disk 108 through the telescopic sleeve 110. The protrusion 109 on the adjustment disk 108 moves as it rotates, pulling the connected rope 129. Since the rope 129 has a fixed length and is connected at the other end to the swinging arm 127, the linear motion of the rope 129 is converted into the rotational motion of the swinging arm 127, ultimately lifting the weight arm 128 against gravity to complete the training movement. This design achieves a dual mechanism for resistance adjustment and efficient force transmission, allowing users to flexibly choose the adjustment method based on training needs. The entire transmission system converts leg movements into the lifting of weight plates through mechanical linkage, ensuring not only the smoothness and effectiveness of the training process but also significantly enhancing the adaptability and training experience of the equipment.

Specifically, referring to FIGS. 1 and 4, in this embodiment, the multi-angle positioning function of the adjustment disk 108 allows users to quickly switch between different training modes with simple adjustments while maintaining the same sitting posture, enabling targeted training for different leg muscle groups. Specifically, the user first locks the angle of the adjustment disk 108 through the adjustment pin 114 to preset the working position of the drive roller 121. During kick training, the drive roller 121 is adjusted to the front upper position of the leg, and extending the leg upward to drive the roller 121 effectively trains the quadriceps; during leg curl training, the drive roller 121 is adjusted to the rear lower position of the leg, and bending the leg downward to pull the roller 121 targets the hamstring muscles. This innovative design eliminates the cumbersome processes of changing positions and re-securing found in traditional equipment, making mode switching simple, fast, and safe. Users can efficiently perform multi-muscle group circuit training in a single session, significantly improving training efficiency and continuity while reducing safety risks associated with frequent posture changes, making it particularly suitable for users requiring comprehensive leg training.

In summary, the present disclosure achieves the following technical effects:

Through the collaborative operation of the multi-angle adjustable adjustment disk 108 and the telescopic sleeve 110, users can quickly and safely switch between kicking and leg-curling training modes while maintaining the same sitting posture. This effectively trains different muscle groups such as the quadriceps and hamstrings, completely addressing the issues of single functionality, cumbersome mode switching, and disrupted training rhythm in traditional leg training devices. Additionally, the independently adjustable leg press roller 138, backrest 147, and dual resistance adjustment system significantly enhance the device's adaptability to users of different body types and improve training comfort. This achieves high convenience and a user-friendly experience for comprehensive leg training while boosting efficiency and safety.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A leg training device for seated bidirectional training, comprising:

a base;

a seat arranged on the base;

a resistance system for providing a training resistance;

a main upright fixedly mounted on the base;

an adjustment disk rotatably mounted on the main upright, the adjustment disk comprising a plurality of adjustment holes for angle positioning;

a telescopic sleeve, comprising an outer tube and an inner tube slidably nested within the outer tube, the outer tube rotatably mounted on the main upright and adjacent to the adjustment disk;

an angle locking mechanism for locking the adjustment disk and the telescopic sleeve at a selected angle;

a drive roller mounted at a distal end of the inner tube of the telescopic sleeve; and a transmission mechanism connected between the adjustment disk and the resistance system for transmitting rotation of the drive roller to the resistance system;

wherein by selectively locking an angle of the adjustment disk and the telescopic sleeve through the angle locking mechanism, the drive roller is switchable between different angular positions from a front upper position to a rear lower position of a leg, enabling a user to perform both kick training and leg curl training in a same sitting posture.

2. The leg training device for seated bidirectional training according to claim 1, wherein the resistance system comprises a swinging arm, and the swinging arm comprises a weight arm, allowing users to adjust a resistance by adding or removing weight plates to/from the weight arm.

3. The leg training device for seated bidirectional training according to claim 2, wherein the transmission mechanism comprises a rope and a pulley assembly, with one end of the rope connected to the adjustment disk and the other end connected to the weight arm after passing around the pulley assembly.

4. The leg training device for seated bidirectional training according to claim 1, wherein the angle locking mechanism comprises an adjustment pin insertable into the adjustment holes and a return spring assembly for keeping the adjustment pin in an inserted state, and the angle locking mechanism is configured to lock the adjustment disk and the telescopic sleeve at the selected angle.

5. The leg training device for seated bidirectional training according to claim 4, wherein the return spring assembly is a spring sleeved on the adjustment pin.

6. The leg training device for seated bidirectional training according to claim 5, wherein the angle locking mechanism further comprises a limiting plate fixedly mounted on the adjustment pin, with one end of the spring abutting against the limiting plate and the other end abutting against the outer tube of the telescopic sleeve.

7. The leg training device for seated bidirectional training according to claim 1, wherein the adjustment disk is generally circular, with the plurality of adjustment holes arranged in a circumferential array on an outer ring portion of the adjustment disk.

8. The leg training device for seated bidirectional training according to claim 1, wherein the base comprises a leg press bar laterally arranged beside the seat, providing an unobstructed front access channel for the user, significantly enhancing the convenience of getting on and off the device.

9. The leg training device for seated bidirectional training according to claim 8, wherein a distal end of the main upright is provided with a rotating shaft that extends toward the second vertical bar to form an extension part; and the adjustment disk and the outer tube of the telescopic sleeve are rotatably mounted on the extension part.

10. The leg training device for seated bidirectional training according to claim 1, wherein the base comprises a first crossbar and a second crossbar arranged parallel to each other; and a first vertical bar and a second vertical bar are arranged between the first crossbar and the second crossbar, thereby forming a rectangular frame.

11. A leg training device for seated bidirectional training, comprising:

a base;

a seat arranged on the base;

a resistance system for providing a training resistance;

a main upright fixedly mounted on the base;

an adjustment disk rotatably mounted on the main upright, the adjustment disk comprising a plurality of adjustment holes for angle positioning;

a drive arm assembly, with a proximal end thereof rotatably mounted on the main upright and arranged adjacent to the adjustment disk, a length of the drive arm assembly being adjustable;

an angle locking mechanism for locking the adjustment disk and the drive arm assembly at a selected angle;

a drive roller mounted at a distal end of the drive arm assembly;

and a transmission mechanism connected between the adjustment disk and the resistance system for transmitting rotation of the drive roller to the resistance system;

wherein by selectively locking an angle between the adjustment disk and the drive arm assembly through the angle locking mechanism, the drive roller is switchable between different angular positions from a front upper position to a rear lower position of a leg, enabling a user to perform both kick training and leg curl training in a same sitting posture.

12. The leg training device for seated bidirectional training according to claim 11, wherein the drive arm assembly is a telescopic sleeve comprising an outer tube and an inner tube slidably nested within the outer tube.

13. The leg training device for seated bidirectional training according to claim 12, wherein the drive arm assembly further comprises a length adjustment mechanism for locking an extension length of the inner tube; and the length adjustment mechanism comprises a first threaded pin, a first threaded hole on a side wall of the outer tube, and a plurality of first through holes distributed axially along the inner tube; and the first threaded pin is capable of passing through the first threaded hole and insert into any first through hole to lock the inner tube.

14. The leg training device for seated bidirectional training according to claim 11, wherein the base comprises a leg press bar laterally arranged beside the seat, providing an unobstructed front access channel for the user, greatly enhancing the convenience of getting on and off the device.

15. The leg training device for seated bidirectional training according to claim 11, wherein the resistance system comprises a swinging arm, and one end of the swinging arm is equipped with a weight arm.

16. The leg training device for seated bidirectional training according to claim 15, wherein the transmission mechanism comprises a rope, with one end of the rope connected to the adjustment disk and the other end connected to the swinging arm.

17. The leg training device for seated bidirectional training according to claim 11, wherein the angle locking mechanism comprises an adjustment pin insertable into the adjustment holes and a return spring assembly for keeping the adjustment pin in an inserted state, and the angle locking mechanism is configured to lock the adjustment disk and the drive arm assembly at the selected angle.

18. The leg training device for seated bidirectional training according to claim 17, wherein the return spring assembly is a spring sleeved on the adjustment pin.

19. The leg training device for seated bidirectional training according to claim 18, wherein the angle locking mechanism further comprises a limiting plate fixed on the adjustment pin, with one end of the spring abutting against the limiting plate and the other end abutting against the drive arm assembly.

20. The leg training device for seated bidirectional training according to claim 11, wherein a distal end of the main upright is provided with a rotating shaft, the rotating shaft comprises an extension part, and the adjustment disk and a proximal end of the drive arm assembly are rotatably mounted on the extension part.

* * * * *